US005224615A

United States Patent [19]

Hickerson

[11] Patent Number: 5,224,615

[45] Date of Patent: * Jul. 6, 1993

[54] CHILD RESISTANT CONTAINER AND SAFETY CLOSURE

[76] Inventor: Frederick R. Hickerson, R.D. 6 Box 530, Newton, N.J. 07860

[ * ] Notice: The portion of the term of this patent subsequent to Oct. 22, 2008 has been disclaimed.

[21] Appl. No.: 741,610

[22] Filed: Aug. 7, 1991

[51] Int. Cl.[5] ..... B65D 55/02

[52] U.S. Cl. ..... 215/218; 215/201; 215/221; 215/330

[58] Field of Search ..... 215/221, 330, 305, 219, 215/217, 216, 218, 354, 335, 330

[56] References Cited

U.S. PATENT DOCUMENTS

| | | | |
|---|---|---|---|
| 2,153,426 | 4/1939 | McNamara et al. | 215/330 X |
| 2,162,880 | 6/1939 | Brown | 215/330 |
| 2,980,275 | 4/1961 | Lundgren | 215/330 |
| 3,233,769 | 2/1966 | Jessop | 215/217 X |
| 3,486,654 | 12/1969 | Schellhas | 215/335 |
| 3,729,110 | 4/1973 | Taylor | 215/216 |
| 3,858,740 | 1/1975 | Lestaevel | 215/221 X |
| 3,905,509 | 9/1975 | Markowitz | 215/330 X |
| 4,002,258 | 1/1977 | Curry | 215/219 X |
| 4,006,836 | 2/1977 | Micallef | 215/218 |
| 4,399,921 | 8/1983 | Kusz | 215/218 |
| 4,512,484 | 4/1985 | Mar | 215/221 |
| 4,865,209 | 9/1989 | Bush | 215/216 |
| 4,874,102 | 10/1989 | Jessop et al. | 215/354 X |
| 5,027,954 | 7/1991 | Hickerson | 215/201 |
| 5,058,754 | 10/1991 | Hickerson | 215/201 |

*Primary Examiner*—Allan N. Shoap
*Assistant Examiner*—Paul A. Schwarz

[57] ABSTRACT

A container for storing a hazardous product, a lock ring assembled into a neck groove portion of the container and a safety closure threaded over the container to seal the container and encircle the lock ring. An extending tab, on the bottom of the lock ring, is exposed and manually held stationary during the closure removal procedure. The neck groove portion and a mating inside peripheral wall of the lock ring both have equal axis offsets from a central axis of the mating threads on the closure and the container. These offset axes are positioned in alignment to permit closure removal when the extending tab of the lock ring is in contact with an alignment shoulder in the neck groove portion of the container. Serrations on the outside serrated surface of the lock ring and the inside serrated surface of the closure are concentric with the threads on the closure and the container when the offset axes are in alignment. The serrations grip lock together when the offset axes go out of alignment which occurs when the closure removal is attempted improperly. The proper procedure of holding the extending tab stationary to maintain its alignment position against the alignment shoulder of the neck groove portion of the container will allow unthreading and removal of the closure.

6 Claims, 5 Drawing Sheets

CHILD RESISTANT CONTAINER AND SAFETY CLOSURE

BACKGROUND OF THE INVENTION

This invention relates to a child resistant container and safety closure which furthers the "state of the art" of my child proof container and safety closures disclosed in U.S. Pat. Nos. 5,027,954 and 5,058,754 issued on Jul. 2, 1991 and Oct. 22, 1991, respectively.

A variety of child resistant safety closures have been designed and marketed which are intended to prevent yound children from opening containers of fluid, semi-fluid and solid medicine and other potentially dangerous products. Most of these safety closures prevent accidental opening by children in accordance with their design features, but have a common problem of being difficult for adults to open, particularly the elderly and people who are physically handicapped.

For example, many child resistant container systems for aspirin and other medicines utilize arrows or other marks on the closure and container which must be aligned before the closure can be pryed off. These systems appear to work well to prevent accidental opening by children but are not considered to be adult easy, since the alignment marks are hard to see and/or feel, the closure is very tight on the container and difficult to rotate to the exact alignment point, and is also hard to pry off even after proper alignment. The push down and twist safety closure systems now on the market, also are apparently good to prevent opening by children but because of the relatively high push and twist forces needed for opening, are not considered adult easy and are a real problem for the elderly and the handicapped. The above and other child resistant closure systems, which by design require relatively high forces in one direction or another, are difficult for adults to open. Because of this, and increasing number of adults purposely leave the closure off or loose on the container once it has been opened, to avoid the annoyance of having the same problem to re-open it every time they want to use the contents. this procedure is considered dangerous to children, as it defeats the purpose of child resistant container systems. Providing reliable seals for sealing containers of hazardous liquid fluids has also been a concern for designers of child resistant container systems.

SUMMARY OF THE INVENTION

The main object of the present invention is to overcome the above problems and other disadvantages of child resistant container and safety closure assemblies now on the market by providing a simple and inexpensive assembly which enhances safety for the child and at the same time makes it easier for adults, including the elderly and the handicapped, to remove the closure from the container.

Another object of the present invention is to further the state of the art of my previous inventions referenced above.

A further object of the present invention is to provide a safety closure consisting of a small number of molded parts which can be simply molded and assembled by current manufacturing machinery and equipment with the result that the safety closure is of relatively low cost.

Still another object of the present invention is to provide a safety closure which can be removed from the container with a minimal force by following a simple removal procedure.

Yet another object of the present invention is for improved sealing means between the container and closure which will provide a reliable seal for containing liquid fluids, semi-fluids and solids.

A further object of the present invention is to provide a safety closure that requires only minor modification to existing container neck designs in order to accommodate the lock ring and closure, such modification having little or no effect on the production costs of containers and closures.

More particularly, the present invention is predicated upon the concept of providing a child resistant container and safety closure assembly utilizing a unique grip locking system. In this invention, a threaded closure engages a lock ring which is rotatably engaged with the neck of the container. The closure also seals the container. To remove the closure, an extending tab extending outwardly on the bottom of the lock ring is held stationary by a finger on the hand holding the container while the closure is unthreaded from the container using the other hand. Attempting to remove the closure in a conventional manner, holding the container in one hand and manipulating the closure and/or the extending tab with the other hand, will be unsuccessful due to a jamming action of the grip locking system. A split in the lock ring allows it to spring open sufficiently to be engaged with the neck of the container, abort a mating neck groove in the container neck. This feature of the invention is significant as the engagement of the lock ring with the container is greatly simplified and adaptable to current production machinery and methods.

More particularly, in a preferred embodiment, the axis of the outer periphery of the aforesaid neck groove of the container is offset slightly from the central axis of its threaded portion. A lock ring with a similar offset, between the axis of its inside peripheral wall and its outside serrated surface rotatably engages the groove in the container's neck. Serrations on the inside surface of the closure, which is threaded onto the container, are lightly engaged with the serrations on the outside serrated surface of the lock ring when the axis of the lock ring and the central axis of the container are in alignment. The axes of the lock ring and the container are in collinear alignment when a protruding, extending tab of the lock ring which extends outwardly from the bottom of the lock ring is set against an axis alignment shoulder or abutment at an end of an arcuate slot or recess in the neck groove. When threading the closure onto the container, the tab closes against the abutment; this puts the axes of the ring and container, in collinear alignment with one another. This alignment allows the closure to rotate clockwise to the fully closed position with only a slight drag force created by the slight touching contact of the serrations on the closure slipping past the serrations on the lock ring. When an attempt is made to remove the closure in an improper manner, counter-clockwise rotation of the closure without holding the extending tab of the lock ring against the abutment to maintain the axes alignment, the lightly contacting serrations on the lock ring and the closure will cause the lock ring to rotate together with the closure, with resulting grip locking as the offset axis of the lock ring goes out of alignment with the axis of the container preventing removal of the closure. As additional force is applied when attempting to remove the closure incorrectly, the locking becomes even greater, preventing removal of the closure. To remove the closure, once grip locking has occurred, the closure is simply retightened on the container by rotating is in a clockwise direction to (a) realign the foresaid axes and (b) allow the correct removal procedure to be followed. Although small tooth-shaped serrations on the serrated surfaces of the lock ring and closure are preferred, most any type surfaces, including ones that are nearly smooth, will also cause the ring rotate with the closure and provide the required grip locking. In the preferred embodiment, a lip on the neck portion of the container seals against a flat surface on the inside of the closure, additional alternative sealing means for improved safety are provided.

One advantage of the present invention is that the removal of the safety closure, when performed in the specified manner, requires an applied force approximately equal to the required force normally needed to open a conventional threaded closure. Thus, an adult who follows the specified procedure can readily remove the safety closure even though the adult may suffer from an affliction which limits the force he can apply to remove the safety closure.

Another advantage of the present invention is that accidental removal of the safety closure by young children is close to impossible since children will nearly always hold the container in one hand while attempting to remove the closure with the other hand. Children will not put a finger of the hand holding the container on the extending tab to block its rotation at the same time they are trying to remove the closure with the other hand, and therefore will not be able to remove the closure. The grip lock system of the invention prevents removal of the safety closure when the container is hand held and the lock ring is allowed to rotate to cause the grip locking.

An additional advantage of the present invention is that alternative sealing means is provided for sealing hazardous liquid fluids and semi-solids which require extra safety precautions to prevent leakage.

A still further advantage of the present invention is that the removal procedure for the closure does not require any special visual observations and can readily be performed in the dark and by persons with impaired vision.

Another advantage of the present invention is that, in addition to the container, only two molded parts are required: the closure and the lock ring, so that the invention may be economically manufactured.

Further objects and advantages of my invention will become apparent from a consideration of the drawings and ensuing description of it.

REFERENCE NUMERALS IN DRAWING

Figure 1:
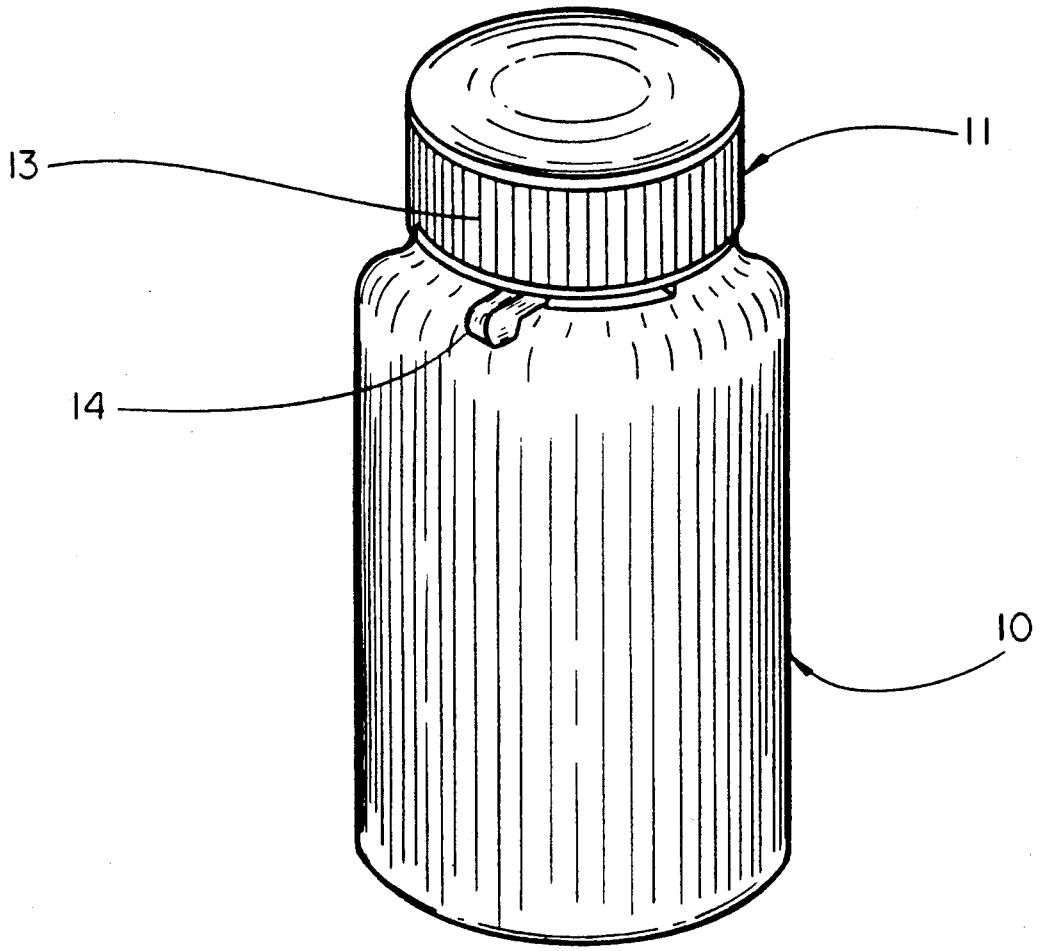
FIG. 1 is a perspective view of a child resistant container and safety closure embodying the invention.

10 container
11 safety closure
12 lock ring
13 corrugated surface
14 extending tab
15 neck portion
16 male thread
17 female thread
18 peripheral wall
19 neck groove portion
20 peripheral wall
21 outside serrated surface
22 split
23 arcuate slot or arcuate recess
24 axis alignment shoulder or abutment
**24*a*** axis offset shoulder
25 inside serrated surface
26 lip
27 flat surface
28 vertical serration
29 container
30 lock ring
31 extending tab
32 neck portion
33 male thread
34 neck groove portion
35 peripheral wall
36 outside serrated surface
37 split
38 alignment bar or abutment
39 arcuate slot or arcuate recess
40 axis alignment shoulder
41 lip
42 axis offset shoulder
43 container
44 closure
45 lock ring
46 corrugated surface
47 extending tab
48 neck portion
49 male thread
50 female thread
51 peripheral wall
52 neck groove portion
53 peripheral wall
54 outside serrated surface
55 alignment bar or abutment
56 axis alignment shoulder or termination
**56*a*** axis offset shoulder or termination
57 inside serrated surface
58 lip
59 flat surface
60 angular serration
61 safety closure
62 internal thread
63 peripheral wall or annular skirt
64 inside serrated surface
65 seat portion
66 flat surface or cap
67 annular plug
68 outside annular surface
inside cylindrical surface

DESCRIPTION OF THE PREFERRED EMBODIMENTS, FIGS. 1 AND 2

Figure 2:
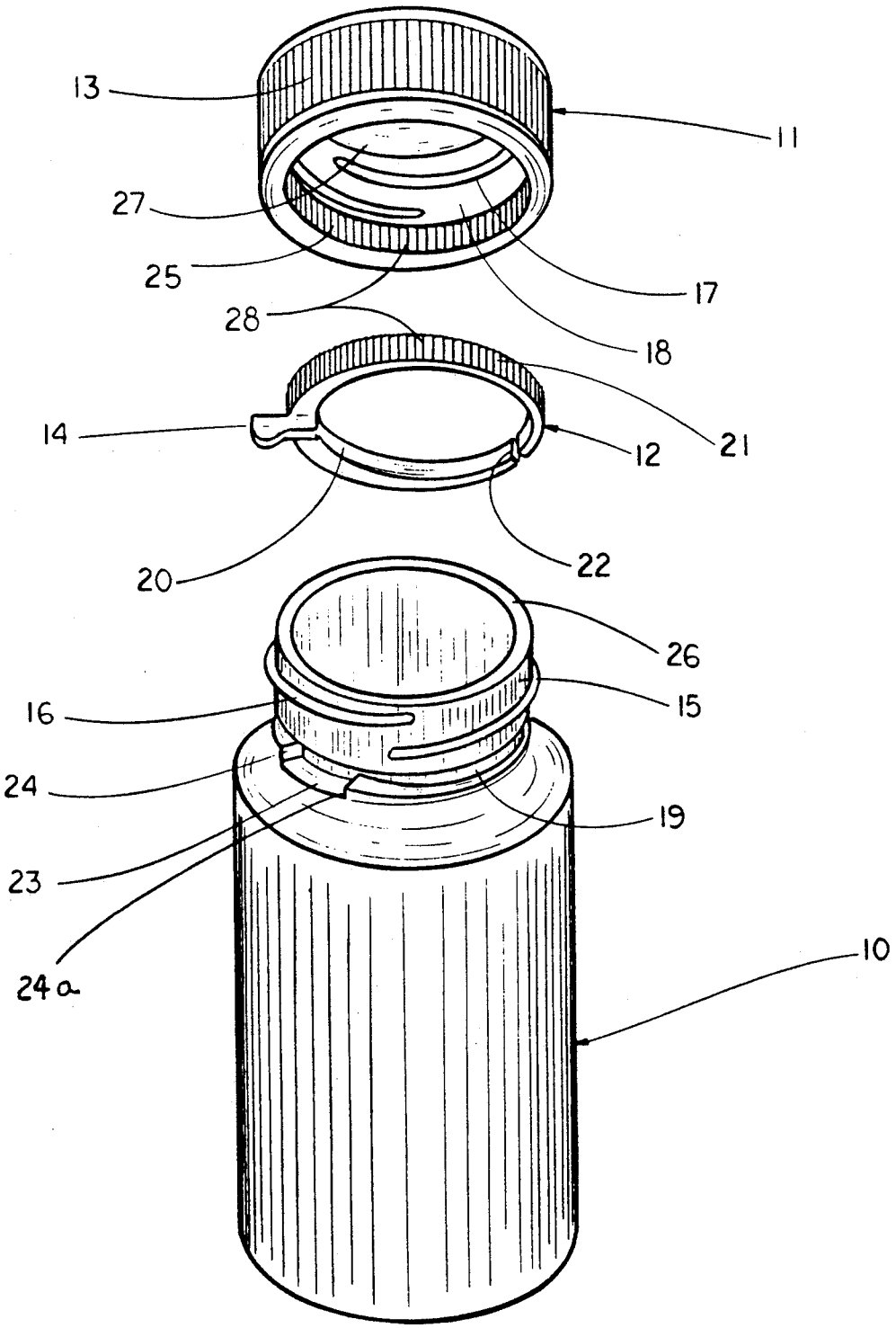
FIG. 2 is an exploded perspective illustrating the safety closure, lock ring with extending tab and container in accordance with the present invention.

Referring first to FIGS. 1-2, there is illustrated a dispensing container designated by numeral 10, preferably but not necessarily in the form of a molded plastic bottle, together with a safety closure 11 and an inner lock ring 12. Also illustrated, is a corrugated surface 13 on the outside periphery of the closure 11 for hand gripping during tightening and removal procedures. An extending tab 14, on the bottom of lock ring 12, is exposed and is intended to be held stationary during the closure 11 removal procedure.

As shown in FIG. 2, the container 10 has a circular neck portion 15 which contains a male thread 16. A female thread 17, located inside a peripheral wall 18 of the closure 11, is in the form of a groove extending about one and one half revolutions and is contoured to freely fit the male thread 16. Container 10 further has a neck groove portion 19, located on the bottom end of the neck portion 15, which defines an axis which is offset from the central axis defined by the circular neck portion 15. The lock ring 12 includes an inner peripheral wall 20 which defines an axis and an outer peripheral wall defining a center axis and having a serrated surface 21, the axis of the inner wall being offset relative to the center axis of the outer wall. The peripheral wall 20 of the lock ring 12 rotatably engages in the neck groove portion 19 of the container 10. A small split 22 in the lock ring 12 allows the lock ring 12 to be sprung open sufficiently to freely slide over the neck portion 15 into it rotatable position about the neck groove portion 19 of the container 10. The extending tab 14 on the lock ring 12 is positioned to extend outwardly in nestably traverse of an arcuate slot or recess 23 formed in the neck groove portion 19 of the container 10. With the lock ring 12 engaged with the groove portion 19 and rotated clockwise, the extending tab 14 will abut against an axis alignment shoulder or abutment 24 of the arcuate slot or recess 23 and the offset, described above for the lock ring 12 and the container 10, will be in collinear alignment with each other in accordance with an object of the invention. In this alignment position, the serrations of the outside serrated surface 21 of the lock ring 12 will be concentric with an inside serrated surface 25 of the closuree 11, and will allow the closure 11 to be threaded clockwise on the container 10, as the inside serrated surface 25 is designed to be concentric with the female thread 17 of closure 11. A slight touching contact between the outside serrated surface 21 and the inside serrated surface 25, in the alignment position, is designed to create a slight contact during rotation of the closure 11 on the container 10. With the closure 11 threaded tightly to the container 10, sealing of the contents of the container 10 occurs as a lip 26 on the neck portion 15 of the container 10 seats on an inner flat surface 27 of the closure 11. A thin sealing disc, not shown in the drawing, can be included between the lip 26 and the inner flat surface 27 to enhance the sealing relationship between the container 10 and the closure 11.

When unthreading the closure 11 from the container 10 in the proper manner, i.e., by holding the extending tab 14 to prevent it from moving away from its contact with the axis alignment shoulder or abutment 24, the slight contact of the serrations on the outside serrated surface 21 and the inside serrated surface 25 does not impede easy removal of the closure 11. When attempting to unthread the closure 11 from the container 10 in an improper manner, i.e., by not holding the extending tab 14 of the lock ring 12 to maintain the aforesaid axial alignment, the counterclockwise rotation to unthread the closure 11 will cause the lock ring 12 to rotate out of alignment on the container 10 into the safety or grip locking position, preventing removal of the closure 11 from the container 10. The lock ring 12 rotates because of the initial light contact between the serrations of the outside serrated surface 21 and the inside serrated surface 25; the contact causes the closure 11 to rotate the lock ring 12 therewith. A portion of the serrations of the outside serrated surface 21 and the inside serrated surface 25 grip lock together, due to the rotation of the extending tab 14 toward an axis offset shoulder **24*a* of the arcuate slot or recess 23**.

With the axis of the ring 12 rotated off the collinear alignment with the axis of the container 10, the inside serrated surface 25 moves into an increasingly jamming or grip locking relationship with the outside serrated surface 21. In this grip locked position, additional force applied to unthread the closure 11 will result in increased jamming of the serrations and it will be impossible to remove the closure 11 from the container 10.

A small vertical serration 28 on both the outside serrated surface 21 of the lock ring 12 and the inside serrated surface 25 of the closure 11, illustrates the configuration of these serrations. While the small vertical serration 29 is highly advantageous, most any type of gripping surface will allow the grip locking relationship.

My prior inventions disclosed the aforecited U.S. Pat. Nos. 5,027,954 and 5,058,754, set forth additional details of the offset axes and the serrations, and are incorporated herein, by reference, for further understanding of such details.

DESCRIPTION OF ALTERNATIVE EMBODIMENTS, FIGS. 3-5

Figure 3:
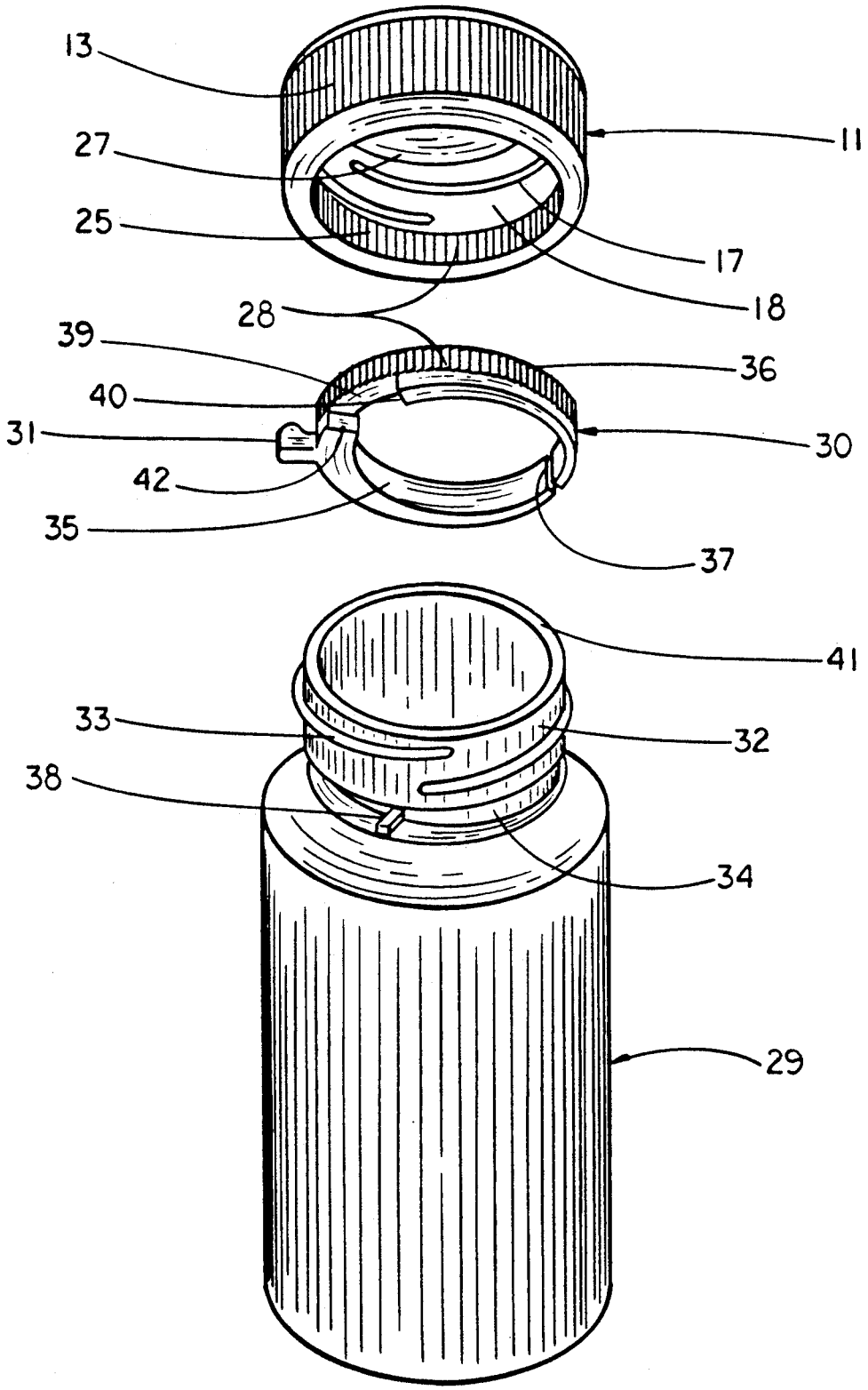
FIG. 3 is an exploded perspective of the invention illustrating a modified alignment system for alignment of the offset axes of the container and lock ring.

FIG. 3 shows the invention with a modified system for alignment of the offset axes. Illustrated is a dispensing container 29 together with the safety closure 11 and a lock ring 30. Also illustrated, is the corrugated surface 13 on the outside periphery of the closure 11.

An extending tab 31, on the bottom of lock ring 30, is exposed and is designed to be held stationary during the closure 11 removal procedure.

As shown, the container 29 has a circular neck portion 32 which contains a male thread 33. The female thread 17, located inside the peripheral wall 18 of the closure 11, is contoured to freely fit the male thread 33. Container 29 further has a neck groove portion 34, located on the bottom end of the neck portion 32, which is intentionally formed with its axis offset from the central axis of the male thread 33. The lock ring 30 is also formed to provide a same axis offset between the inside of a peripheral wall 35 and a peripheral outside serrated surface 36. The lock ring 30 rotatably engages the neck groove portion 34 of the container 29. A small split 37 in the lock ring 30 allows the lock ring 30 to be sprung open sufficiently to freely slide over the neck portion 32 into the neck groove portion 34 of the container 29. A radially disposed alignment bar or abutment 38 formed on the neck groove portion 34 of the container 29 is confined and surmounted by an arcuate slot or recess 39 in the lock ring 30. With the lock ring 30 engaged with the neck groove portion 34 of the container 29 and rotated clockwise, the alignment bar or abutment 38 will be abuttingly engaged by an axis alignment shoulder 40 of the arcuate slot or recess 39 and the axes, described above for the lock ring 30 and the container 29, will be in alignment with each other in accordance with an object of the invention. In this alignment position, the outside serrated surface 36 of the lock ring 30 will be concentric with the inside serrated surface 25 of the closure 11, and will allow the closure 11 to be threaded clockwise on the container 29, as the inside serrated surface 25 is designed to be concentric with the female thread 17 of the closure 11. With the closure 11 threaded tightly to the container 29, sealing of the contents of the container 29 occurs as a lip 41 on the neck portion 32 seats on the inner flat surface 27 of the closure 11.

When unthreading the closure 11 from the container 29 in the proper manner, i.e., by holding the extending tab 31 to prevent the axis alignment shoulder 40 of the lock ring 30 from rotating away from its alignment position contact with the alignment bar or abutment 38 of the container 29, the slight contact of the serrations on the outside serrated surface 36 and the inside serrated surface 25 does not impede easy removal of the closure 11. When attempting to unthread the closure 11 from the container 29 in an improper manner, i.e., by not holding the extending tab 31 of the lock ring 30 to maintain the alignment, the counterclockwise rotation to unthread the closure 11 will cause the lock ring 30 to rotate out of alignment on the container 29 into the safety or grip locking position, preventing removal of the closure 11 from container 29. The lock ring 30 rotates because of the initial light contact between the serrations of the outside serrated surface 36 and the inside serrated surface 25. As the lock ring 30 rotates counterclockwise, the axis alignment shoulder 40 moves away from its alignment contact position against the alignment bar or abutment 38. This movement causes the axes of the lock ring 30 and the container 29 to go out of alignment. With the offset axis of the ring 30 moved off its alignment position, the inside serrated surface 25 moves into an increasing jamming or grip locking relationship with the the outside serrated surface 36, and the closure 11 cannot be removed from the container 29. In order to allow sufficient rotation of the lock ring 30 to effect the grip lock of the lock ring 30 and the closure 11, the extent of the arcuate slot or recess 39 is such that an axis offset shoulder 42 of the arcuate slot or recess 39 cannot contact the alignment bar or abutment 38 of the container 29.

A small vertical serration 28 on both the outside serrated surface 21 of the lock ring 12 and the inside serrated surface 25 of the closure 11, illustrates the configuration of these serrations.

Figure 4:
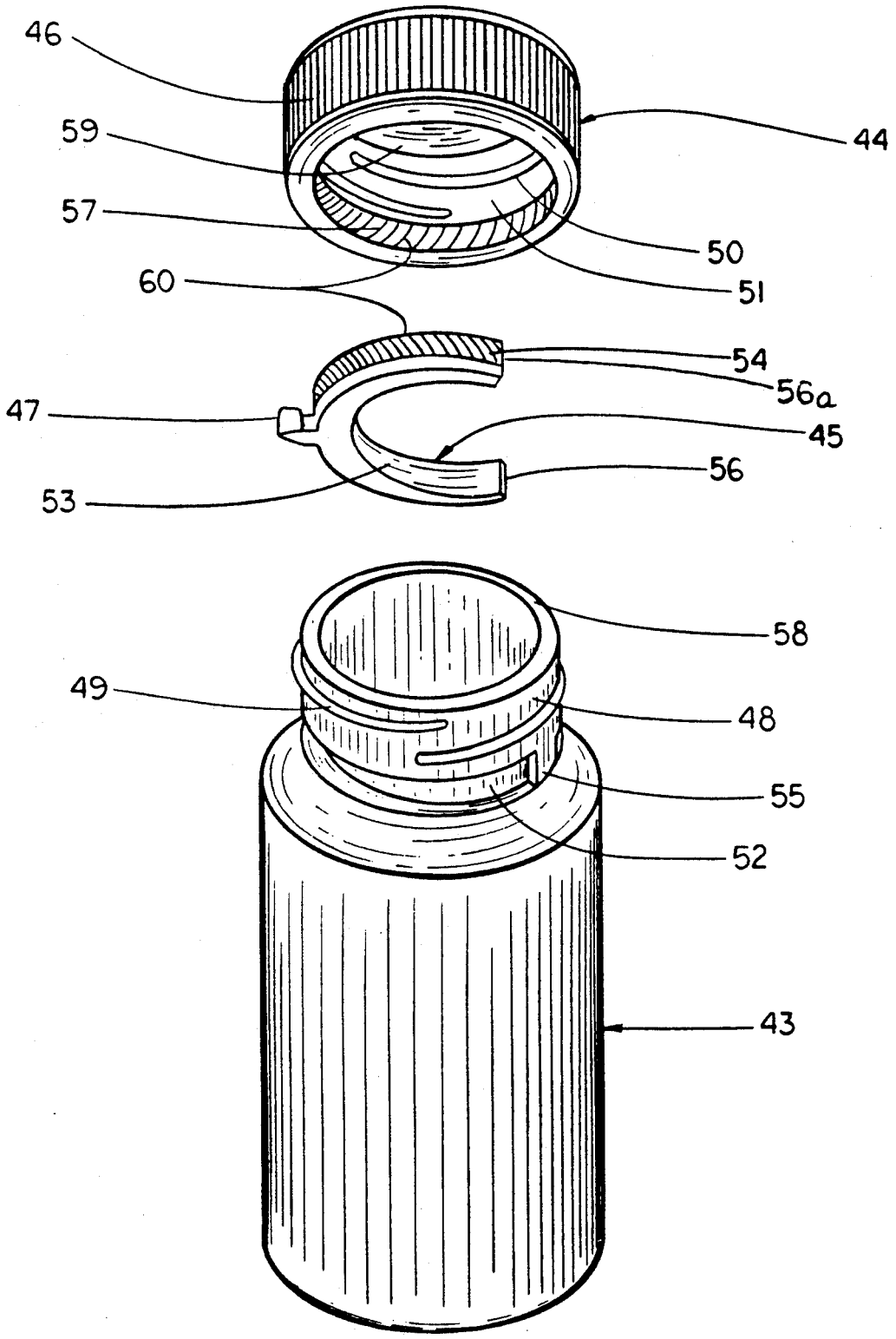
FIG. 4 is an exploded perspective of the invention illustrating another modified alignment system, and also a modified serration design.

FIG. 4 shows the invention in another modified alignment system and also a modified serration design to enhance sealing of the contents of the container. Illustrated is a dispensing container 43, together with a safety closure 44 and a C-shaped lock ring 45. Also illustrated, is a corrugated surface 46 on the outside periphery of closure 44. An extending tab 47, on the bottom of lock ring 45, is exposed and is intended to be held stationary during the closure 44 removal procedure.

As shown, the container 43 has a circular neck portion 48 which contains a male thread 49. A female thread 50, located inside a peripheral wall 51 of closure 44 is contoured to freely fit the male thread 49. Container 43 further has a neck groove portion 52, located at the bottom end of the neck portion 48, which is formed with its axis offset from the central axis of the male thread 49. The lock ring 45 is also formed to provide a same axis offset between an inside peripheral wall 53 and a peripheral angular outside serrated surface 54. the lock ring 45 rotatably engages the neck groove portion 52 of the container 43.

The C-shaped lock ring 45 is designed to spring open sufficiently to assemble from the side, into the neck groove portion 52 of the container 43.

A vertical alignment bar or abutment 55 in the neck groove portion 52 of the container 43, provides an alignment stop for the lock ring 45. With the lock ring 45 attached to the container 43 and rotated clockwise, an axis alignment shoulder or termination 56 on the lock ring 45 will seat against the alignment bar or abutment 55 in the neck groove portion 52 of the container 43. The offset described above for the lock ring 45 and the container 43 will then be in alignment with each other in accordance with an object of the invention. In this alignment position, the angular outside serrated surface 54 of the lock ring 45 will be concentric with an angular inside serrated surface 57 of the closure 44, and will allow the closure 44 to be threaded clockwise on the container 43, as the serrated surface 57 is designed to be concentric with the female thread 50 of the closure 44. A slight touching contact between the outside serrated surface 54 and the inside serrated surface 57, in the alignment position, is designed to create a slight contact during rotation of the closure 44 on the container 43. With the closure 44 threaded tightly to the container 43, the sealing of the contents of the container 43 occurs as a lip 58 on the neck portion 49 seats on an inner flat surfact 59 of the closure 44.

When unthreading the closure 44 from the container 43 in the proper manner, i.e., by holding the extending tab 47 to prevent the axis alignment shoulder or termination 56 of the lock ring 45 from moving away from its abutting engagement with the alignment bar or abutment 55 in the neck groove portion 52 of the container 43, the slight contact of the serrations on the outside serrated surface 54 and the inside serrated 57 does not impede easy removal of the closure 44. When attempting to unthread the closure 44 from the container 43 in an improper manner, i.e., by not holding the extending tab 47 of the lock ring 45 to maintain alignment, the counterclockwise rotation to unthread the closure 44 will cause the lock ring 45 to rotate, toward an axis offset shoulder or termination **56*a* out of alignment on the container 43 into the safety or grip locking position, preventing removal of the closure 44 from container 43. A small angular serration 60 on both the outside serrated surface 54 of the lock ring 45 and the inside serrated surface 57 of the closure 44, illustrates the configuration of these serrations. The angular serration 60 is configured as a small tooth on an angle of about 45 degrees. The angular configuration of the serrations are designed to provide some downward force to hold the closure 44 against the container 43 during improper removal attempts. This downward force will keep the lip 58 of the container 43 in a sealing relationship with the flat surface 59 of the closure 44, when the closure 44 has been rotated counterclockwise a few degrees moving the lock ring 45** out of its alignment position into grip locking as previously described.

Figure 5:
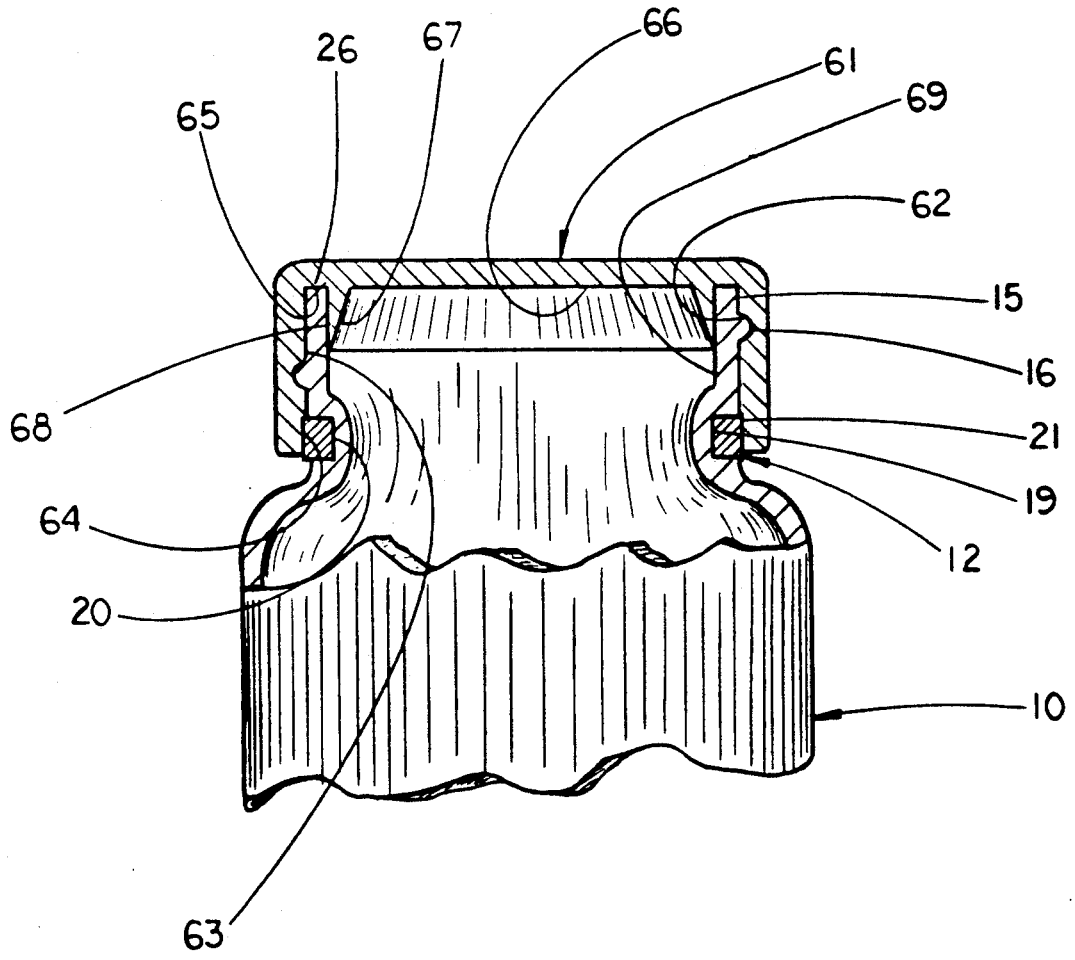
FIG. 5 is a vertical sectional view of the invention illustrating a modified closure design.

FIG. 5 is a vertical sectional view of the invention illustrating a modified safety closure design.

As shown in FIG. 5, there is illustrated the dispensing container 10, a safety closure 61 and the lock ring 12. The container 10 and the lock ring 12 are also shown in FIG. 2, which illustrates the preferred embodiments of the invention. The closure 11 shown in FIG. 2 has been replaced in FIG. 5 by the alternative design of the closure 61.

Referring to FIGS. 2 and 5, the male thread 16 or the upper neck portion 15 of the container 10 mates with a female thread 62 located inside a peripheral wall or annular skirt 63 of the closure 61. The female thread 62 is designed to freely fit the male thread 16 of the container 10. The neck groove portion 19, located on the bottom end of the neck portion 15 of the container 10, is formed with its axis offset from the central axis of the male thread 16. The lock ring 12 is also designed to provide a same axis offset between the inside of the peripheral wall 20 and the peripheral outside serrated surface 21. The peripheral wall 20 of the lock ring 12 rotatably engages the neck groove portion 19 of the container 10. The small split 22 in the lock ring 12 allows the lock ring 12 to be sprung open sufficiently to freely slide over the neck portion 15 into its rotatably mating position in the neck groove portion 19 of the container 10. The extending tab 14 on the lock ring 12 is positioned to extend outwardly in a nestable traverse of the arcuate slot or recess 23 in the neck groove portion 19 of the container 10. With the lock ring 12 attached to the container 10 and rotated clockwise, the extending tab 14 will seat against the axis alignment shoulder 24 of the arcuate slot 23 and the axes, described above for the lock ring 12 and the container 10, will be in alignment with each other in accordance with an object of the invention. In this alignment position, the serrations of the outside serrated surface 21 of the lock ring 12 will be concentric with an inside serrated surface 64 of the closure 61, and will allow the closure 61 to be threaded clockwise on the container 10 since the inside serrated surface 64 is designed to be concentric with female thread 62 of the closure 61. A slight touching contact between the outside serrated surface 21 and the inside serrated surface 64, in the alignment position, is designed to create a slight contact during rotation of the closure 61 on the container 10. With the closure 61 threaded tightly to the container 10, primary sealing of the contents of the container 10 occurs as the lip 26 on the neck portion 15 of the container 10, seals against a circular seat portion 65 of a cap or inner flat surface 66.

When the closure 61 is not threaded tightly to the container 10 and the lip 26 does not seal against the seat portion 65, a second sealing system prevents possible leakage of the contents of the container 10. In this secondary sealing system design, illustrated in FIG. 5, an integrally formed annular plug 67 depends from the cap or inside annular flat surface 66. An outside annular surface 68 of the annular plug 67 is sized for an interference fit within an inside cylindrical surface 69 of the container 10. The annular plug 67 provides a continuous sealing engagement during withdrawal from the inside cylindrical surface 69 as the closure 61 is unthreaded from the container 10, preventing leakage of the contents of the container 10.

OPERATION OF THE INVENTION, FIGS. 1-5

Assuming that it is desired to remove the safety closure 11 from the container 10, as illustrated in FIGS. 1 and 2, a person first holds the container 10 in one hand and uses a finger of the same hand to prevent the extending tab 14 of the lock ring 12 from rotating. Then, gripping the corrugated surface 13 on the closure 11 with the other hand, the closure 11 is simply unthreaded from the container 10 in the normal counterclockwise direction, completing the safety closure 11 removal procedure. By holding the extending tab 14 from rotating during the closure 11 removal procedure, the axes of the lock ring 12 and the container 10 are maintained in their collinear alignment position, allowing removal of the closure 11. In the alignment position, the extending tab 14 of the lock ring 12 remains in abutting engagement with the axis alignment shoulder or abutment 24 of the arcuate slot or recess 23 in the neck groove portion 19 of the container 10, maintaining the concentric alignment required to allow removal of the safety closure 11. To replace the closure 11 on the container 10, a person merely threads the closure 11 on the container 10 in a normal manner. The clockwise rotation of the closure 11 automatically moves the tab 14 of the lock ring 12 into its alignment position i.e., in abutting engagement with the abutment 24 of the container 10 due to the lightly contacting serrated surfaces of the lock ring 12 and the closure 11.

Assuming now the container 10, with the safety closure 11 attached, contains a harmful or dangerous medicine or other hazardous product, and is in the possession of a child, his or her efforts to remove the closure 11 will be unsuccessful despite the various manipulations that will be tried. Holding the container 10 in one hand and trying to rotate the closure 11 in a clockwise or tightening direction will be unsuccessful. Should the child try to unscrew the closure 11 by rotating it in a counterclockwise direction, the closure 11 and the lock ring 12 will rotate slightly into a jamming or grip locking relationship and the child's efforts will again be unsuccessful. After grip locking occurs, the closure 11 cannot be removed until it is retightened on the container 10 and the proper opening procedure followed. The above grip locking relationship occurs because the contacting serrations on the outside serrated surface 21 of the lock ring 12 and the inside serrated surface 25 of the closure 11 causes the lock ring 12 to also rotate counterclockwise with the closure 11. As the lock ring 12 rotates, the extending tab 14 of the lock ring 12 moves away from its contact with the axis alignment shoulder or abutment 24 in arcuate slot or recess 23 in the neck groove portion 19 of the container 10, causing the axes of the ring 12 and container 10 to go out of alignment. With the offset axis of the neck groove portion 19 of the container 10 out of alignment with the offset axis of the peripheral wall 20 of the lock ring 12, the outside serrated surface 21 jams or grip locks with the inside serrated surface 25 of the closure 11.

As long as the child holds the container 10 in one hand and tries to manipulate the safety closure 11 and/or the extending tab 14 of the lock ring 12 in one direction or another, the closure 11 can not be removed. There is virtually no chance that the child will use a finger of the hand holding the container 10 to prevent the rotation of the extending tab 14, on the lock ring 12, to the grip locking position while attempting to remove the closure 11 with the other hand. Nearly all adults will also be baffled in their attempts to remove the safety closure 11 until the proper removal procedure is revealed to them. This removal procedure is truly adult easy, as the required force to remove the closure 11 is approximately equal to the force normally required to unthread closures from comparable, regular, non-child-resistant container assemblies. The procedure is also extremely simple and can be accomplished quickly even in the dark.

For FIGS. 3 and 4, which illustrate alternative embodiments of the invention, the closure removal and replacement procedures are basically the same as that described above for the preferred embodiments of the invention illustrated in FIGS. 1 and 2. While the design of the alignment means is different in each of the illustrations, FIGS. 2-4, the operating instructions are the same. A person operating these variations of the invention would not normally notice any difference between them. The alternative alignment means embodiments allows manufacturers to consider optional methods and procedures for producing and assembling the invention which can result in reduced manufacturing costs. In comparing these alignment means, FIG. 2 illustrates an alignment means comprising the extending tab 14 of the lock ring 12 contacting the axis alignment shoulder or abutment 24 of the arcuate slot or recess 23 of the container 10 to achieve the required alignment position for the closure 11 removal from container 10. FIG. 3 illustrates an alignment means comprising the axis alignment shoulder 40 in the arcuate slot or recess 39 in the lock ring 30 contacting the alignment bar or abutment 38 in the neck groove portion 34 of the container 29 to achieve the required alignment position. FIG. 4 illustrates an alignment means comprising the axis alignment shoulder or terminating 56 of the lock ring 45 contacting the alignment bar or abutment 55 in the neck groove portion 52 of the container 43 to achieve the required alignment position. It is to be understood that the neck portion 48 like the neck portions 15 and 32, comprise a neck (of the container 43, or containers 29 and 10) which has an outer periphery. Logically then, neck portions 15, 32 and 48 each have an outer periphery.

FIGS. 4 and 5 illustrate alternative embodiments of the invention which are designed to provide improved sealing for containment of highly hazardous liquid products. A child attempting to open the container 43, as shown in FIG. 4, in an improper manner, will be unsuccessful since grip locking of the serrations will occur due to a few degrees of counterclockwise rotational movement of the closure 44 and the lock ring 45. The child may then squeeze the container 43 in an effort to force the liquid contents of the container 43 to leak out past the sealing surface contact between the lip 58 of the container 43 and the inner flat surface 59 of the closure 44. His or her efforts can be expected to be unsuccessful due to the angular design of the serrations on the inside serrated surface 57 of the closure 44 and the outside serrated surface 54 of the lock ring 45. With the angular serrations grip locked together, there will be a resulting downward force exerted on the closure 44 by the lock ring 45 which is prevented from moving upward by its assembly into the neck groove portion 52 of the container 43. The possibility of the closure 44 being forced upward and loosened on the container 43 is remote due to the opposing downward force created by the grip locked, angular serrations.

As shown in FIG. 5 improved sealing of the contents of the container 10 is obtained by the addition of a second sealing means in the design of the closure 61. A child attempting to remove the closure 61 from the container 10 in an improper manner will be unsuccessful since grip locking will occur as previously described. Any normal efforts by the child to squeeze or stand on the container 10 or suck on the closure 61 will not cause leakage since a secondary sealing system is designed into the closure 61. The primary sealing contact between lip 26 of the container 10 and the seat portion 65 of the cap or flat surface 66 of the closure 61 may become partially ineffective. This occurs as the pressure in the container 10 forces the closure 61 to move upward on the container to the extent the looseness of the threads will allow. The looseness in the threads is caused by the few degrees of rotation of the closure 61 on the container 10. The secondary sealing system prevents leakage as the annular plug 67 provides a continuous sealing engagement during its withdrawal from the inside cylindrical surface 69. The liquid pressure in the container 10, due to the child's action of standing on the container 10, actually enhances the sealing relationship of the annular plug 67 with the inside cylindrical surface 69. This occurs since the liquid pressure on the inside of the annular plug 67 forces its outside annular surface 68 into an even tighter sealing relationship with the inside cylindrical surface 69 of the container 10.

The plug type seal can be roughly compared to the plunger type seal in the tubular section of a common hand-operated tire pump.

The embodiments of the invention as illustrated and described above are thus seen to represent distinct advances and improvements in the technology of child resistant containers and safety closures.

Although the description contains many specifics, these should not be construed as limiting the scope of the invention but as merely providing illustrations of some presently preferred and alternative embodiments of the invention. For example, the number and shape of the serrations on the serrated surfaces can be varied. The improved sealing systems, shown in FIGS. 4 and 5 can be adapted separately or together on all adaptations of the invention. The plug type seal, illustrated in FIG. 5, can be of modified design where the lower part of the annular plug 67 of the closure 61 could have a flexible thin annular feather edge. A suitable sealing disc or sealing ring may be used in all adaptations of the invention as may be required by the nature of the contents of the container to be sealed. An additional number of extending tabs could be included on the lock ring designs illustrated in FIGS. 3 and 4. The angular serrations of FIG. 4 could be of helical design.

While the illustrations and descriptions of the invention contained herein are oriented toward a child resistant container and safety closure to protect your children from opening containers of medicine and other dangerous products, it is obvious that the invention is also adaptable for other similar uses. For example, a similar adaptation of the invention would prevent children from opening containers of jewelry, valuable items, important papers and other items a person does not want a young child to get their hands on.

Thus the scope of the invention should be determined by the appended claims and their legal equivalents, rather than by the examples given.

I claim:

1. A child resistant container and safety closure, comprising:

a. a container for storing a product, having a circular neck portion having a neck groove portion defining an axis which is offset from a central axis defined by the neck portion, said neck groove having an alignment abutment:

b. a closure, in rotatably removable engagement with said neck portion, for sealing and for opening said container, said closure having a flat surface and an annular skirt depending from said flat surface, said skirt defining an inner peripheral wall, said inner peripheral wall having a serrated surface;

c. a split annular lock ring having a serrated outer surface, said outer surface defining a central axis of said lock ring, said lock ring having an inner peripheral wall defining an axis which is offset from the central axis defined by the outer surface of said lock ring, said lock ring having an axis alignment shoulder and an axis offset shoulder, said lock ring being rotatively engaged in said neck groove portion of said neck portion;

d. said lock ring having an alignment means for rotating said lock ring wherein the rotation of said lock ring in a first direction causes said axis alignment shoulder of said lock ring to effect an abuting engagement with said alignment abutment of said neck groove portion, said central axis of said lock ring aligning with said central axis of said neck portion, said serrated outer surface of said lock ring being in slight touching contact with said serrated surface on said inner peripheral wall of said closure thereby allowing said closure to be removed from said container, and wherein the rotation of said lock ring in a second direction causes said axis offset shoulder of said lock ring to effect an abuting engagement with said alignment abutment of said neck groove portion, said central axis of said lock ring being offset from said central axis of said neck portion, said serrated outer surface of said lock ring being engaged with said serrated surface of said inner peripheral wall of said closure thereby preventing removal of said closure.

2. The child resistant container and safety closure as defined in claim 1 wherein said arcuate recess in said lock ring further comprises an arcuate recess, said arcuate recess defining said axis alignment shoulder and said axis offset shoulder.

3. The child resistant container and safety closure as defined in claim 1 wherein said serrated surfaces vertically formed have serrations.

4. The child resistant container and safety closure as defined in claim 1 wherein said serrated surfaces are diagonally formed have serrations.

5. The child resistant container and safety closure as defined in claim 1 wherein said alignment means comprises an extending tab extending outwardly from said lock ring for effecting rotation of said lock ring.

6. The child resistant container and safety closure as defined in claim 1 wherein said closure further comprises an annular plug concentric with said annular skirt for sealingly engaging an inside cylindrical surface of said neck portion of said container, said annular plug depending from said flat surface.

* * * * *